US006517242B1

(12) United States Patent
Buchman

(10) Patent No.: US 6,517,242 B1
(45) Date of Patent: Feb. 11, 2003

(54) RECLOSABLE PACKAGE; AND METHODS

(75) Inventor: James E. Buchman, Hortonville, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 10/083,208

(22) Filed: Oct. 24, 2001

(51) Int. Cl.[7] ..... B65D 33/34

(52) U.S. Cl. ..... 383/5; 383/61.2; 383/64; 383/107; 383/204; 493/213

(58) Field of Search ..... 383/5, 61.2, 107, 383/203, 204, 64; 493/213; 53/412

(56) References Cited

U.S. PATENT DOCUMENTS 5,131,121 A 7/1992 Herrington, Jr. et al.
5,161,286 A 11/1992 Herrington, Jr. et al.
5,829,884 A 11/1998 Yeager
5,902,047 A 5/1999 Yeager
5,954,433 A 9/1999 Yeager
6,131,369 A * 10/2000 Ausnit ..... 53/412
6,178,722 B1 1/2001 McMahon
6,212,857 B1 * 4/2001 Van Erden ..... 53/412
6,216,423 B1 4/2001 Thieman
6,264,366 B1 7/2001 Custer
6,273,607 B1 8/2001 Buchman
6,287,001 B1 * 9/2001 Buchman ..... 383/64
6,290,390 B1 9/2001 Buchman
6,290,391 B1 9/2001 Buchman
6,293,896 B1 * 9/2001 Buchman ..... 493/213
6,327,837 B1 * 12/2001 Van Erden ..... 53/412
6,409,384 B1 * 6/2002 Provan et al. ..... 383/5
6,461,043 B1 * 10/2002 Healy et al. ..... 383/204

* cited by examiner

*Primary Examiner*—Jes F. Pascua
(74) *Attorney, Agent, or Firm*—Mara E. Liepa; Tracey D. Beiriger

(57) ABSTRACT

A method of making packages having a reclosable zipper closure encased in a tamper-evident structure, and the packages made thereby. The method includes providing a package having an interior defined by a bottom seam and side seams. The side seams are present as a body seam and a tamper-evident structure seam; there is no side seam present across the zipper closure. The lack of a side seam present across the zipper closure facilitate removal of the tamper-evident structure. A slider device may be present on the packages to facilitate mating and unmating of the zipper closure.

19 Claims, 9 Drawing Sheets

RECLOSABLE PACKAGE; AND METHODS

FIELD OF THE DISCLOSURE

This disclosure concerns reclosable packages. In particular, this disclosure describes reclosable packages having slider devices for opening and closing the packages, and methods of manufacturing the packages.

BACKGROUND

Flexible packages, in particular resealable and recloseable packages, are frequently used for packaging of consumable goods. Goods that are not used completely when the package is initially opened rely on a zipper closure to reclose the package and keep the remaining contents fresh. Examples of consumable goods that are often packaged in packages, such as bags, with a zipper closure include potting soil, fertilizer, socks, pet food, dog biscuits, vegetables, cereal, and many different foods edible by humans.

Often, the opening and closing of the zipper closure is facilitated by a slider device that is mounted on the zipper closure. The slider device is constructed to pry apart the interlocking zipper closure members when the slider device is moved in a first direction along the zipper, and to engage the interlocking zipper closure members when the slider device is moved in a second, opposite direction along the zipper. For some applications, a tamper-evident structure, to notify whether access has been gained to the zipper closure, is desired. Improvements in these types of packages are desirable.

SUMMARY OF THE DISCLOSURE

The present disclosure relates to a method of manufacturing a package, such as a flexible bag, having a resealable, reclosable zipper mechanism or closure. The package interior is defined by panels having a bottom edge and first and second side edges, the side edges having seams formed by a sealing process. The seam at each of the first and second side edges does not extend the entire length of the side edge; rather, the intersection of the zipper closure with the side edge is not sealed. The zipper closure has stop areas, positioned proximate the side edges, which include seal resistant portions. The seal resistant portions do not readily seal to the panels.

In one embodiment, the present disclosure is directed to form, fill and seal processes that manufactures flexible packages having a reclosable zipper closure, fills the packages with items, and seals the filled packages. The form, fill, and seal process can be a horizontal process.

In one particular embodiment, the present disclosure is directed to a method of making a resealable, reclosable package. The method includes providing an extended length of a zipper construction, which includes a zipper closure having stop areas present therein, sealing the extended length of zipper construction to a surrounding wall, creating an external tamper-evident structure, and forming edges in the surrounding wall to form a package interior. The edges formed are defined by body seams, a bottom seam, tamper-evident structure seams, and non-seam area. The resulting package interior may be filled prior to forming all of the seams.

In another particular embodiment, the present disclosure is directed to a method of manufacturing a reclosable package comprising a zipper closure. The method comprises providing an extended length of a zipper construction, sealing the extended length of the zipper construction to a surrounding wall, sealing the surrounding wall to partially define a package interior, and creating a bottom seam. The zipper construction comprises a zipper closure comprising a first closure profile and a second closure profile, the first and second closure profiles being constructed and arranged to selectively interlock, and a stop region connecting the first closure profile to the second closure profile. The step of sealing the surrounding wall to partially define a package interior includes providing side body seams extending along a portion of the surrounding wall and providing non-seam sections along the slider stop region. The bottom seam and the side body seams defining the package interior.

This disclosure also is directed to a resealable, reclosable package made by the methods of this disclosure. In one embodiment, the package has a surrounding wall defining a package interior and a zipper closure and slider device for providing access to the package interior. The zipper closure includes an interlocking first closure profile and second closure profile, each of the closure profiles having a distal end and a sealing flange opposite the distal end.

In one particular embodiment of this disclosure, a flexible, reclosable package is provided. The package comprises a surrounding wall defining a package interior, the surrounding wall being defined by a bottom edge and side edges, with side edges comprising a body seam, a tamper-evident structure seam, and a non-seam section. The package further has a zipper closure and a tamper-evident structure. The zipper closure comprises a first closure profile and a second closure profile, the first and second closure profiles constructed and arranged to selectively interlock, the zipper closure having first and second stop regions proximate the non-seam section, and the zipper closure providing access to the package interior.

DETAILED DESCRIPTION

The addition of a slider device to a flexible package, such as a plastic bag, is advantageous to aging or arthritic persons not having the physical ability to use just a zipper closure to reseal a bag. Additionally, the addition of a tamper-evident structure to the package is advantageous to notifying whether tampering has occurred to the package. The package of the present disclosure includes a slider device to open and close the package, and a first tamper-evident structure to indicate whether access has been gained to the zipper closure and slider device. The package of the present disclosure may include a second tamper-evident structure to indicate whether access has been gained to the interior of the package.

Packages According to the Present Disclosure

Figure 1:
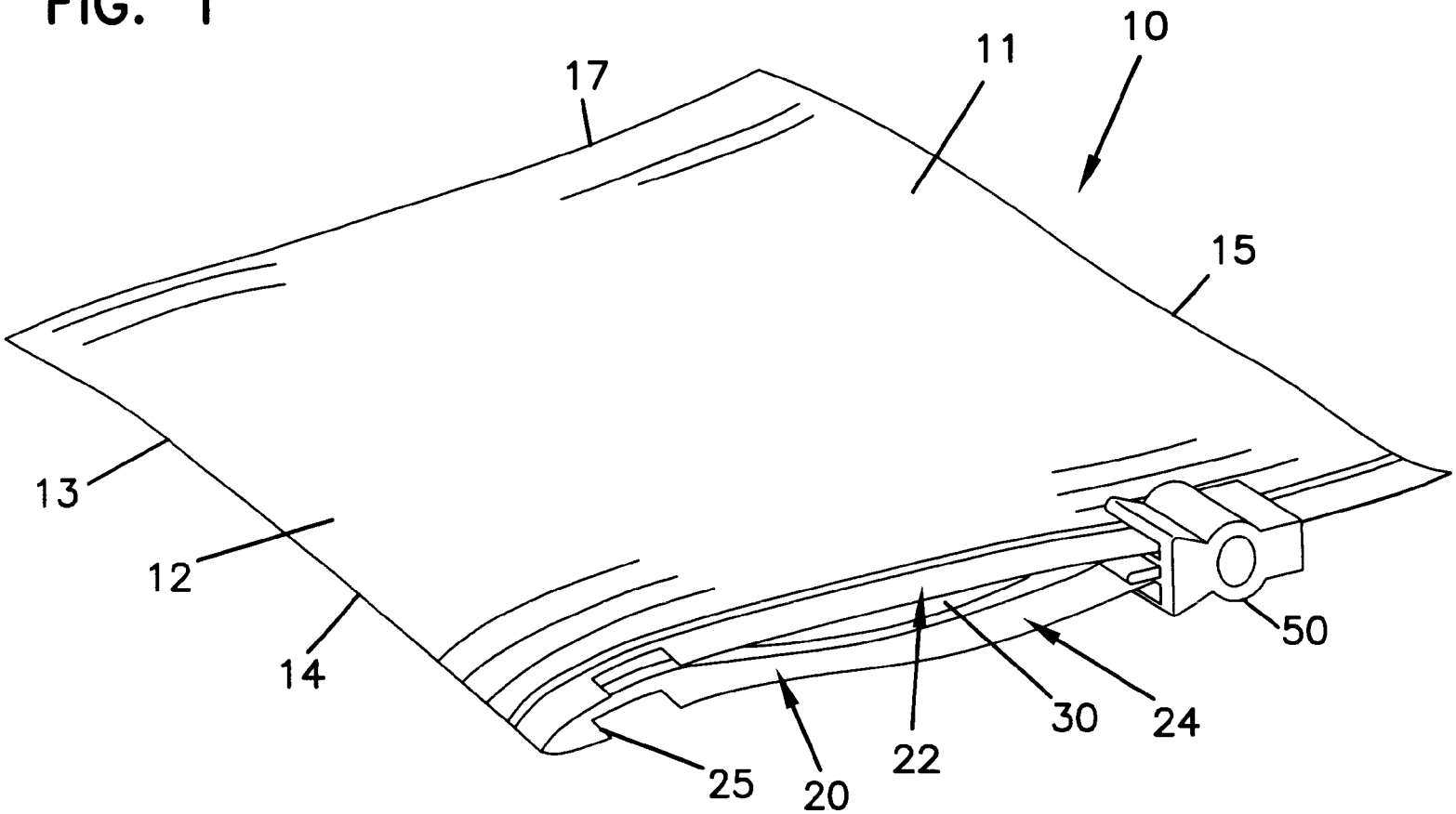
FIG. 1 is a perspective view of a flexible, reclosable package.

Referring to the figures, wherein like numerals represent like parts throughout the several views, there is schematically illustrated in FIG. 1 a flexible, reclosable package 10 having side panels 12 and 14. A surrounding wall 11, formed by side panels 12, 14, defines a package interior 21, shown in FIGS. 4 and 5. Package 10 has side edges 13, 15 and a bottom edge 17, which, with side panels 12, 14, define interior 21. A zipper closure 20, having closure profiles to open and close (unseal and reseal) package 10, provides access to interior 21 through a mouth 30. Zipper closure 20 can include a variety of configurations and structures. For example, zipper closure 20 can be constructed according to PCT Published Application WO 00/22851, which is incorporated by reference herein. Zipper closure 20 has a first closure profile 22 and a second closure profile 24 that mate and unmate, interlock and unlock, engage and disengage, as appropriate, to open and close mouth 30.

Figure 4:
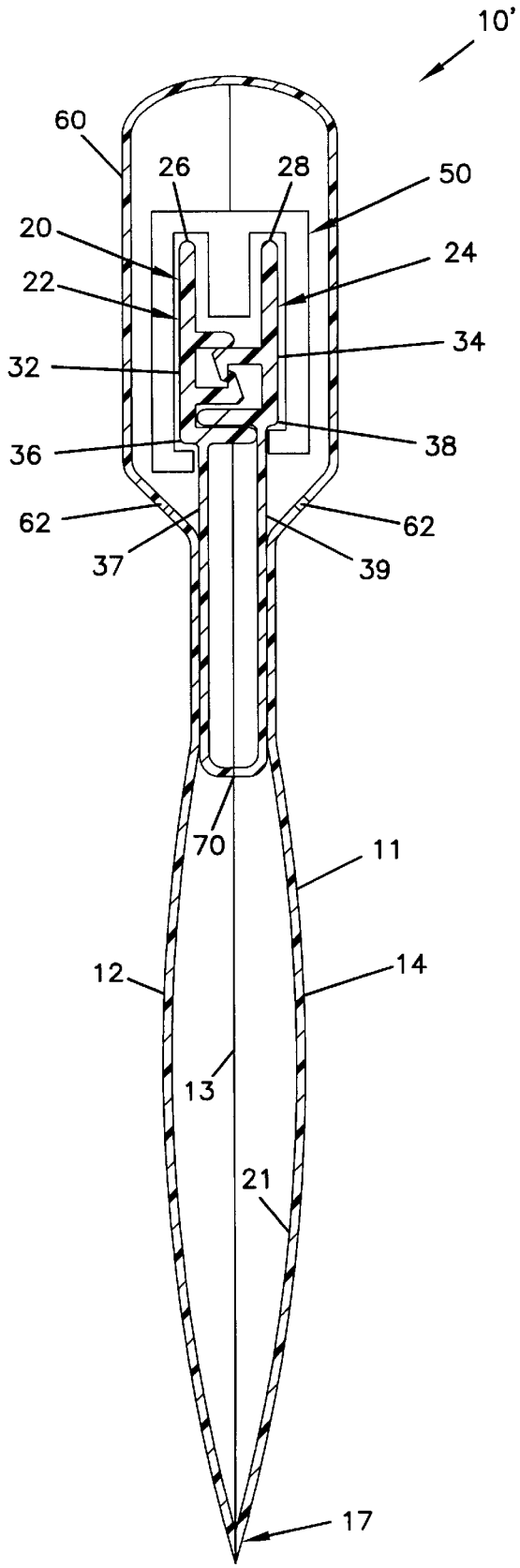
FIG. 4 is a schematic, cross-sectional view of the package taken along line 4—4 of FIG. 3.
Figure 5:
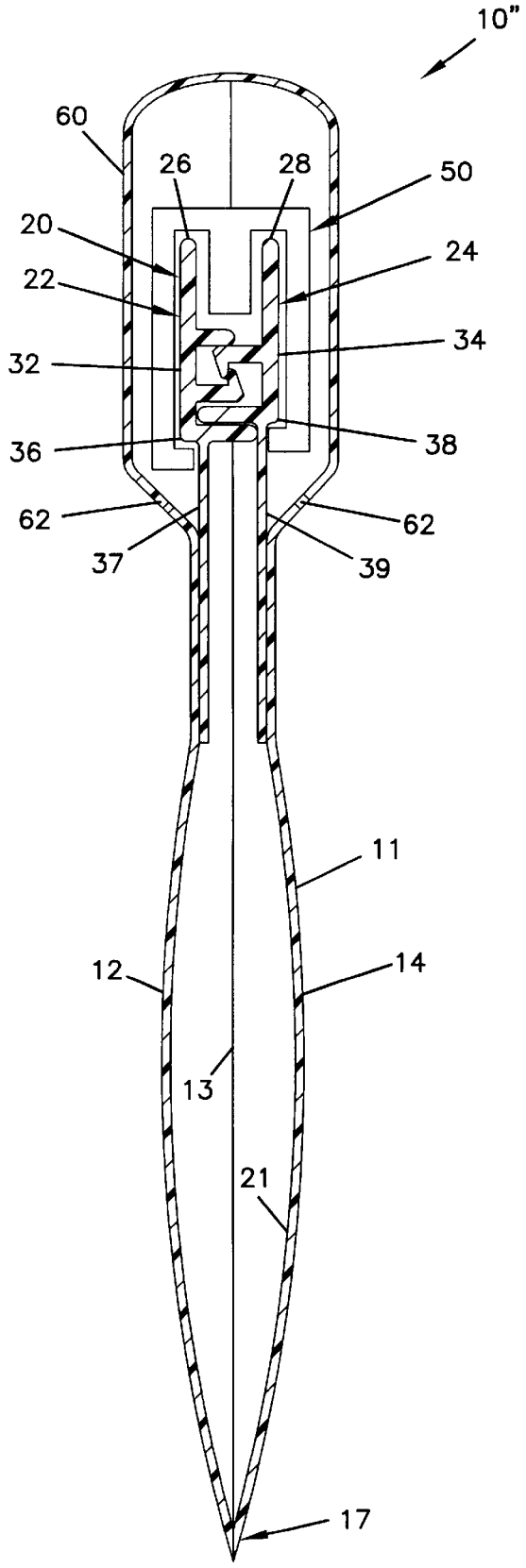
FIG. 5 is a schematic, cross-sectional view of a second embodiment of a package according to the present disclosure, similar to the package of FIG. 4.

Zipper closure 20 is shown in detail in FIGS. 4 and 5. First closure profile 22 includes a first mating member 32 with a distal end 26, a first shoulder 36, and a sealing flange 37; second closure profile 24 includes a second mating member 34 with a distal end 28, a second shoulder 38, and a sealing flange 39. First mating member 32 engages and disengages with second mating member 34.

Preferably, a slider device 50 is mounted on zipper closure 20 to facilitate opening and closing of zipper closure 20. In FIG. 1, slider device 50 is positioned to allow access through mouth 30; that is, package 10 can be considered "open". Slider device 50 is positioned over distal ends 26, 28 and is held onto zipper closure 20 by shoulders 36, 38 of first and second closure profiles 22, 24. Slider devices and how they function to open and close zipper closures, in general, are taught, for example, in U.S. Pat. Nos. 5,063,644; 5,301,394; and 5,442,837, each of which is incorporated by reference herein. Preferred slider devices taught in PCT Published Application WO 00/22851, U.S. Design Pat. No. 434,345, U.S. and U.S. patent application Ser. No. 09/918,982 filed Jul. 31, 2001, each of which is incorporated herein by reference in its entirety. Although shown schematically in FIGS. 1, 4 and 5, slider device 50 is preferably constructed and arranged in accordance with the disclosures of PCT Published Application WO 00/22851, U.S. Design Pat. No. 434,345, and patent application Ser. No. 09/918,982.

Referring again to the embodiment shown in FIG. 1, a notch 25 is present within zipper closure 20 adjacent to first side edge 13 in the package 10. Notch 25 is designed to provide a "park place" into which slider device 50 settles when zipper closure 20 is sealed and slider device 50 is at first edge 13. Such a notch 25 may decrease any tendency for an incomplete interlock between first closure profile 22 and second closure profile 24.

Figure 2:
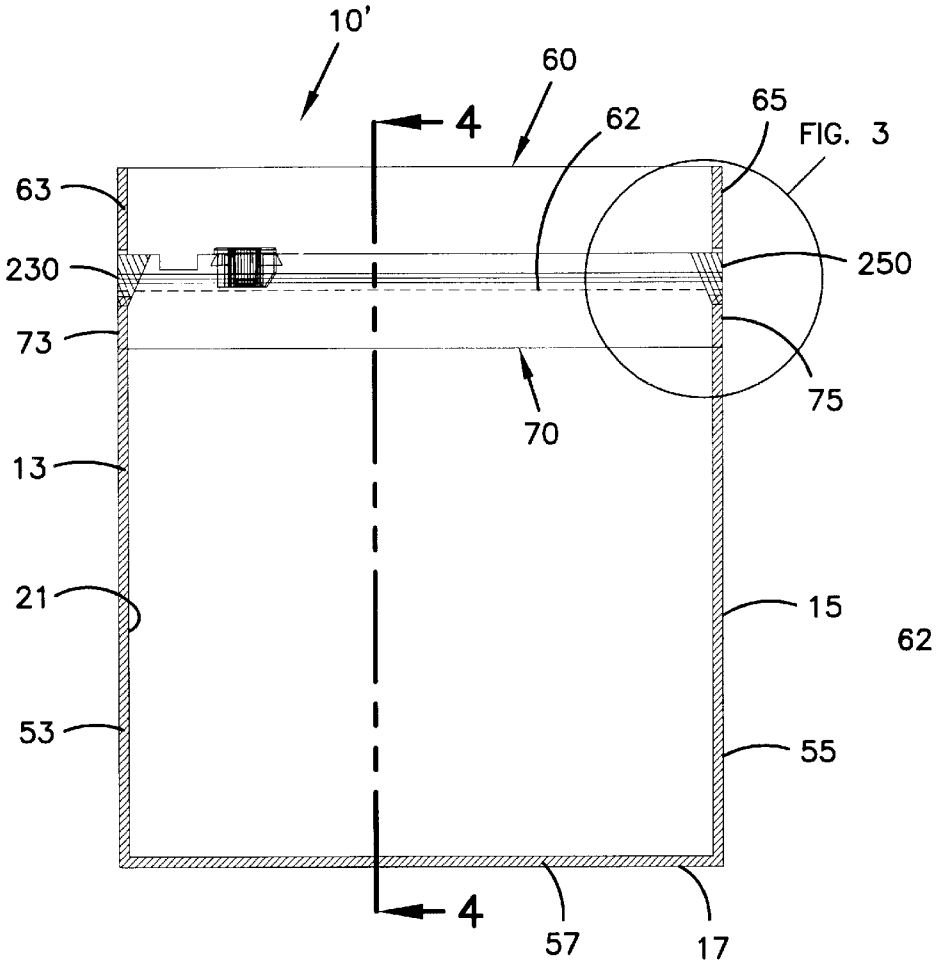
FIG. 2 is a partially schematic, front plan view of a flexible, reclosable package having a tamper-evident structure according to the present disclosure.

Package 10 is shown in FIG. 1 without a tamper-evident structure positioned over or encasing slider device 50. In FIG. 2, a package 10' is similar to that of package 10 of FIG. 1, except that package 10' has a tamper-evident structure 60 positioned over and encasing zipper closure 20 and slider device 50. Additionally, package 10' has a second tamper-evident structure 70 positioned between zipper closure 20 and interior 21 of package 10'. Package 10' is shown in cross-section in FIG. 4. Additional details of package 10' are also shown in FIGS. 2 and 4, when compared to package 10 of FIG. 1.

Referring to FIGS. 2 and 4, first tamper evident-structure 60 surrounds, covers, encases, and otherwise protects first and second closure profiles 22, 24 so that the profiles cannot be separated without penetrating tamper evident-structure 60. First tamper-evident structure 60 also covers slider device 50, which is mounted on closure profiles 22, 24. First tamper evident-structure 60 is considered an "external" tamper evident-structure because it is positioned external to zipper closure 20 in relation to the package interior 21. First tamper evident-structure 60 is not a structure that is commonly referred to as a "peel seal"; rather, tamper evident-structure 60 is a structure such as a membrane, film, web, or the like that extends from panels 12, 14 and covers distal ends 26, 28 of zipper closure 20 and slider device 50. First tamper-evident structure 60 is typically formed from extensions of panels 12, 14 that are positioned over zipper closure 20; these extensions of panels 12, 14 may be two unconnected ends of panels 12, 14 or may be formed by a crease or fold between connected panels 12, 14. In other embodiments, tamper-evident structure 60 can be made from a separate web folded over and attached to panels 12, 14.

To gain access to zipper closure 20, first tamper evident-structure 60 is penetrated by removing tamper evident-structure 60, which is preferably done at a weakness 62. Weakness 62 can be a perforation, tear-strip, zip-strip, die line, laser score line, or any mechanism or structure that allows for easy penetration. Weakness 62 is positioned below zipper closure 20; that is weakness 62 is positioned between zipper closure 20 and bottom edge 17 of the package. Similarly and preferably, weakness 62 is positioned below slider device 50. First tamper-evident structure 60 generally extends from the top of the package, that is, the portion of the package farthest from bottom edge 17, to weakness 62. Specific details regarding one method for making a package having tamper-evident structure 60 are provided below.

Package 10' shown also includes a second tamper evident-structure 70 that extends between sealing flanges 37, 39 of closure profiles 22, 24. Second tamper evident-structure 70 is considered an "internal" tamper evident-structure because it is positioned between zipper closure 20 and the package interior 21. Even after closure profiles 22, 24 have been opened and separated, access cannot be gained to interior 21 without penetrating second tamper-evident structure 70. Although shown as a structure such as a membrane, film, web, or the like that provides a discernible length of distance between sealing flanges, 37, 39, second tamper evident-structure 70 could also be a structure commonly referred to as a "peel seal". If tamper-evident structure 70 is a peel seal or a peelable seal, this seal may be a single use seal or a multiple use seal.

FIG. 5 shows a package 10", a variation of the package having first and second tamper-evident structures. Package 10 is similar to package 10' except that package 10" has first tamper-evident structure 60 external to zipper closure 20 but no second tamper-evident structure internal to zipper closure 20. Tamper-evident structure 60 is the only tamper-evident structure present on package 10". Both packages, package 10' and package 10" can be made by the methods of the present disclosure, described below.

Referring again to FIG. 2 and to FIG. 3, various features of the packages made by the process of the present disclosure will be described. Package 10' has interior 21 defined by first side edge 13, second side edge 15 and bottom edge 17. Each of these edges, 13, 15, 17 has a seal or seam, created by the attachment of panels 12, 14 together. Typically, this sealing is done by the application of heat, under pressure, to at least one panel when in contact with the other panel. At first side edge 13 is a first side body seam 53, at second side edge 15 is a second side body seam, and at bottom edge 17 is a bottom seam 57. First and second side body seams 53, 55 extend from bottom edge 17 to zipper closure 20, but do not extend over zipper closure 20; preferably side body seams 53, 55 do not contact zipper closure 20.

First tamper-evident structure 60 includes first tamper-evident structure seams 63, 65, located at side edges 13, 15, respectively; first tamper-evident structure seams 63, 65 close the ends of tamper-evident structure 60 at side edges 13, 15 so that access cannot be gained to zipper closure 20 through edges 13, 15. First tamper-evident structure seams 63, 65 are also typically made by the application of heat and pressure to the film panels that form tamper-evident structure 60. First tamper-evident structure seams 63, 65 extend from the top of tamper-evident structure 60 to zipper closure 20, but do not contact or extend over zipper closure 20.

If second tamper-evident structure 70 is present in the package, side body seams 53, 55 include second tamper-evident structure seams 73, 75. Second tamper-evident structure seams 73, 75 are seals or seams at edges 13, 15 that are formed where panels 12, 14 and second tamper-evident structure 70 are sealed together, typically by the application of heat and pressure.

Because neither side body seams 53, 55, first tamper-evident structure seams 63, 65, nor second tamper-evident structure seams 73, 75 are present at, extend over, or contact zipper closure 20, side edges 13, 15 include a non-seam section 230, 250, respectively. Non-seam sections 230, 250 are void of side seams. Present within non-seam sections 230, 250 is zipper closure 20, which includes closure profiles 22, 24, including base members 32, 34, distal ends 26, 28, and at least a portion of sealing flanges 37, 39. In other words, the intersection of zipper closure 20 and side edges 13, is void of side seams. By use of the term "void of side seams", it is not intended to mean that there are no areas or spots of material sealed together in that area; rather, it is intended that there is no seam formed between panels 12, 14 and zipper closure 20. Generally, no seam is formed between zipper closure 20 and panels 12, 14 after the zipper closure 20 has been brought into contact with panels 12, 14. In another aspect, non-seam sections 230, 250 are void of seams or seals created by the application of heat and pressure provided by seal bars used to provide the seams 53, 55, 63, 65.

Non-seam sections 230, 250 allow for easy removal of tamper-evident structure 60 by minimizing, and preferably eliminating, any attachment of tamper-evident structure 60 to zipper closure 20. Non-seam sections 230, 250 typically extend from distal ends 26, 28 of zipper closure 20 to at least, and preferably below, weakness 62. By use of the term "below", what is meant is that non-seam sections 230, 250 extend between weakness 62 and bottom edge 17. By having generally no portion of tamper-evident structure 60 above weakness 62 attached to zipper closure 20, tamper-evident structure 60 can be easily removed.

Figure 3:
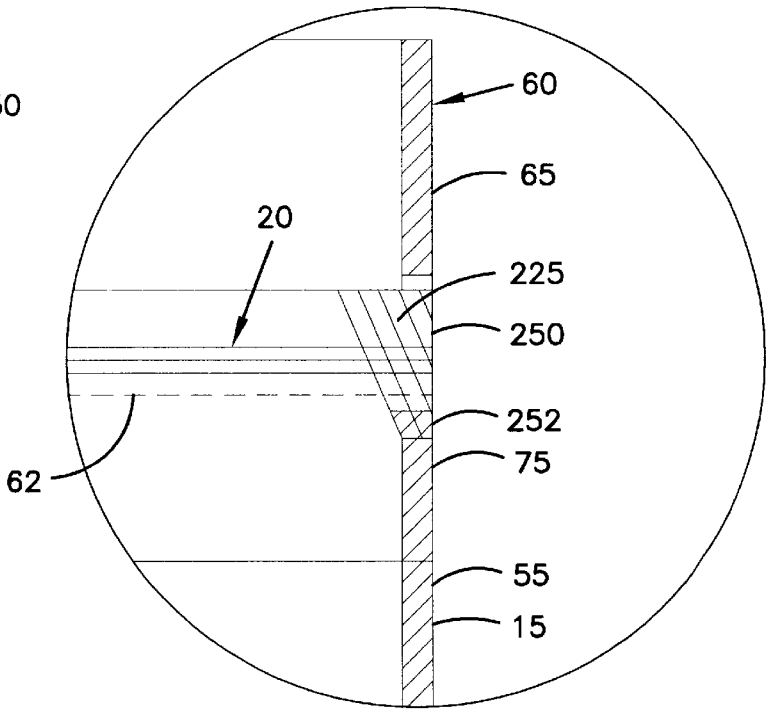
FIG. 3 is an enlarged, partial view of one side edge of the flexible, reclosable package of FIG. 2.

To facilitate the forming of non-seam sections 230, 250, zipper closure 20 has a seal resistant portion 235, 255, with seal resistant portion 235 located at side edge 13 of the package (FIG. 4) and seal resistant portion 255 located at side edge 15 of the package (FIG. 3). These seal resistance portions 235, 255 are constructed to not readily seal to panels 12, 14; that is, during the process of sealing side seams 53, 55 and first tamper-evident structure seams 63, 65 with heat and pressure, seal resistant portions 235, 255 do not readily form a seam with or seal to panels 12, 14. Zipper closure 20, within each seal resistant portion 235, 255 is, however, capable of sealing to itself during an ultrasonic welding process, as will be described below; that is, first closure profile 22 can be attached to second closure profile 24, but neither profile 22, 24 readily seals to panels 12, 14. Seal resistant portions 235, 255 include distal ends 26, 28, base members 32, 34, and the portion of sealing flanges 37, 39 that is positioned above weakness 62. Typically, seal resistant portion 235, 255 includes a portion of sealing flange 37, 39 located below weakness 62, however, the amount of sealing flange 37, 39 present within seal resistant portion 235, 255 should not be so large that sealing flanges 37, 39 do not adequately seal to panels 12, 14.

Seal resistant portion 235, 255 can be made from a different material than panels 12, 14, preferably from a material having a higher melting point temperature than panels 12, 14; this allows seams 53, 55, 63, 65 to be made without melting or distorting zipper closure 20 and without adhering panels 12, 14 to zipper closure 10. Alternately, seal resistant portion 235, 255 can be made from a material that is incompatible with panels 12, 14. As a further alternative, zipper closure 20 can include a high temperature additive or surface coating or a surface wax that inhibits adhesion between zipper closure 20 and panels 12, 14. Any of these various options can be incorporated into zipper closure 20 as a post-treatment or can be co-extruded with zipper closure 20.

Seal resistant portions 235, 255 are present in non-seam sections 230, 250, respectively; it is seal resistant portions 235, 255 that provide non-seam sections 230, 250. In some embodiments, non-seam sections 230, 250 may be larger and occupy more length of sides 13, 15 than seal resistant portions 235, 255.

As stated above, non-seam sections 230, 250 are void of side seams, and instead, include a slider stop region 223, 225. Slider stop regions 223, 225 preferably include areas where closure profiles 22, 24 are sealed together; slider stop regions 223, 225 retain slider device 50 on zipper closure 20. The portions of closure profiles 22, 24 that are sealed can include distal ends 26, 28, mating members 32, 34, and at least a portion of sealing flanges 37, 39. Slider stop regions 223, 225 are typically ultrasoncially welded or otherwise crushed. The crushing results in a mass of plastic (polymeric) material melted or otherwise joined together. In the particular embodiment illustrated, slider stop regions 223, 225 are shown in FIGS. 2 and 3 as angled, almost triangular areas.

A portion of slider stop region 223, 225 may intersect with either or both of first tamper-evident structure side seam 63, 65 and side body seam 53, 5. In FIG. 3, slider stop region 225 intersects with side body seam 55 to form overlap region 252.

Figure 6:
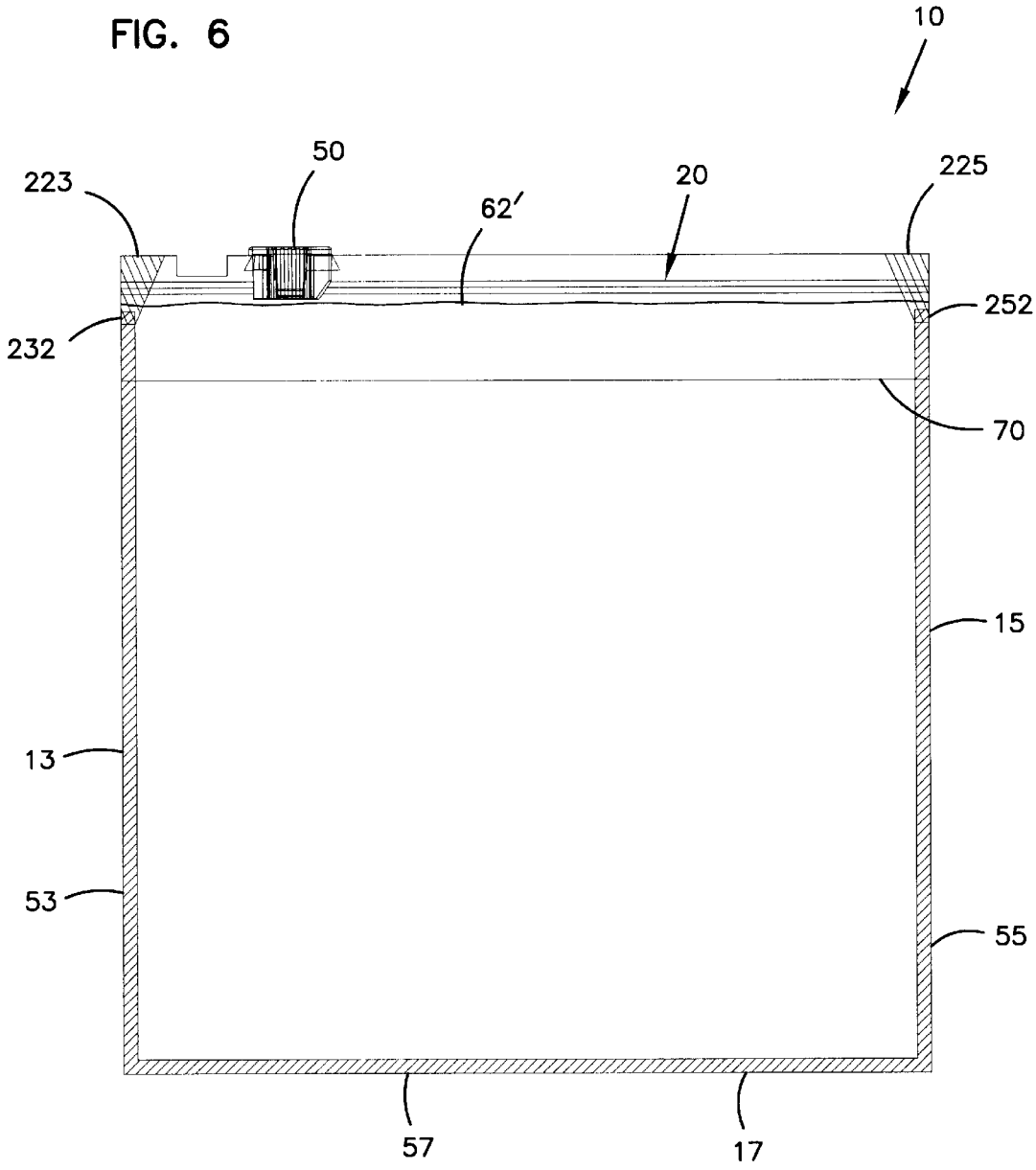
FIG. 6 is a partially schematic, front plan view of the flexible, reclosable package of FIG. 2 according to the present disclosure having the tamper-evident structure removed.

As stated above, in order to gain access to any items within the interior of the package, first tamper-evident structure 60 and second tamper-evident structure 70, if present, need to be penetrated. In FIG. 6, package 10' from FIGS. 2, 3 and 4 is now shown as package 10, having first tamper-evident structure 60 removed and thus allowing access to zipper closure 20 and slider device 50. First tamper-evident structure 60 was removed at weakness 62, thus leaving edge 62' on package 10. Package 10 of FIG. 6 shows various features also shown in FIG. 2, such as side seams 53, 55 at side edges 13, 15, bottom seam 57 at bottom edge 17, slider stop regions 223, 225, and overlap regions 232, 252 where slider stop regions 223, 225 intersect with side seams 53, 55.

Methods of Making Packages According to the Present Disclosure

Packages according to the present disclosure can be made by the following procedure, which is described referring to FIGS. 7 through 10.

Figure 8:
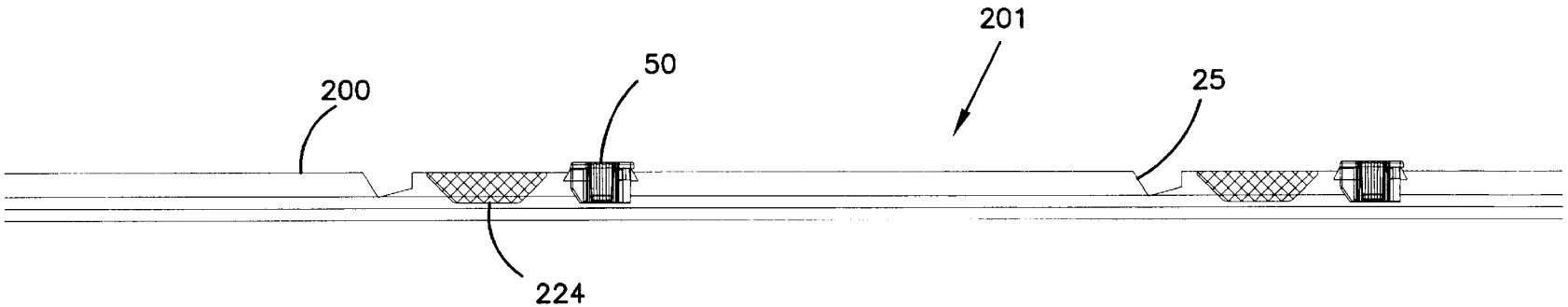
FIG. 8 is a schematic view of an extended length of zipper closure having a slider device mounted thereon.

In a preferred method of making a package having a slider device, slider device 50 is mounted onto zipper closure 20 prior to connecting zipper closure to panels 12, 14. Preferably, zipper closure 20 includes slider device 50, notch 25, and slider stop regions 223, 225 prior to connecting the zipper closure to panels 12, 14. The preferred zipper construction 201, having slider device 50, notch 25, and slider stop regions 223, 225 (shown as one region 224) on extended length of zipper closure 200 is shown in FIG. 8. If no slider device is present, the zipper construction will merely include extended length of zipper closure 200 and region 224.

To provide zipper construction 201 as shown, an extended length of zipper closure 200 is provided on spool 205. Extended length of zipper closure 200 can be made by any suitable method, but is typically extruded. First and second closure profiles 22, 24 can be extruded individually, that is, as two individual profiles, or, closure profiles 22, 24 can be extruded connected at either distal ends 26, 28 or at sealing flanges 37, 39. If closure profiles 22, 24 are connected at their distal ends 26, 28, the two profiles 22, 24 are slit or otherwise separated before mounting slider device 50 onto extended length of zipper closure 200. If closure profiles 22, 24 are connected at the sealing flanges 37, 39, the two profiles 22, 24 may or may not be separated. If not separated but left connected, the web connecting sealing flanges 37, 39 provides tamper-evident structure 70.

As mentioned, extended length of zipper closure 200 is provided via spool 205. In another embodiment, zipper closure 20 may be extruded, cast or otherwise formed immediately before this process, thereby eliminating the step of winding extended length of zipper closure 200 onto spool 205 after forming the zipper closure 20 and then unwinding when slider devices 50 are mounted.

First and second closure profiles 22, 24 may be interlocked (mated) or unmated while retained on spool 205. If closure profiles 22, 24 are unmated, in some embodiments it may be desired to have first closure profile 22 on a first spool and second closure profile 24 on a second spool. It should be noted, that interlocked profiles can be unmated as desired, and unmated profiles can be mated as desired. In most embodiments, it is desired that profiles 22, 24 are mated.

Zipper closure 20 is unwound from spool 205 and fed to slider mounting system 100. Any zipper drive unit or tensioning unit can be provided to control the winding of zipper closure 20 from spool 205. At slider mounting system 100, zipper closure 20 undergoes various processes, including having slider device 50, if present, mounted thereon.

Figure 7:
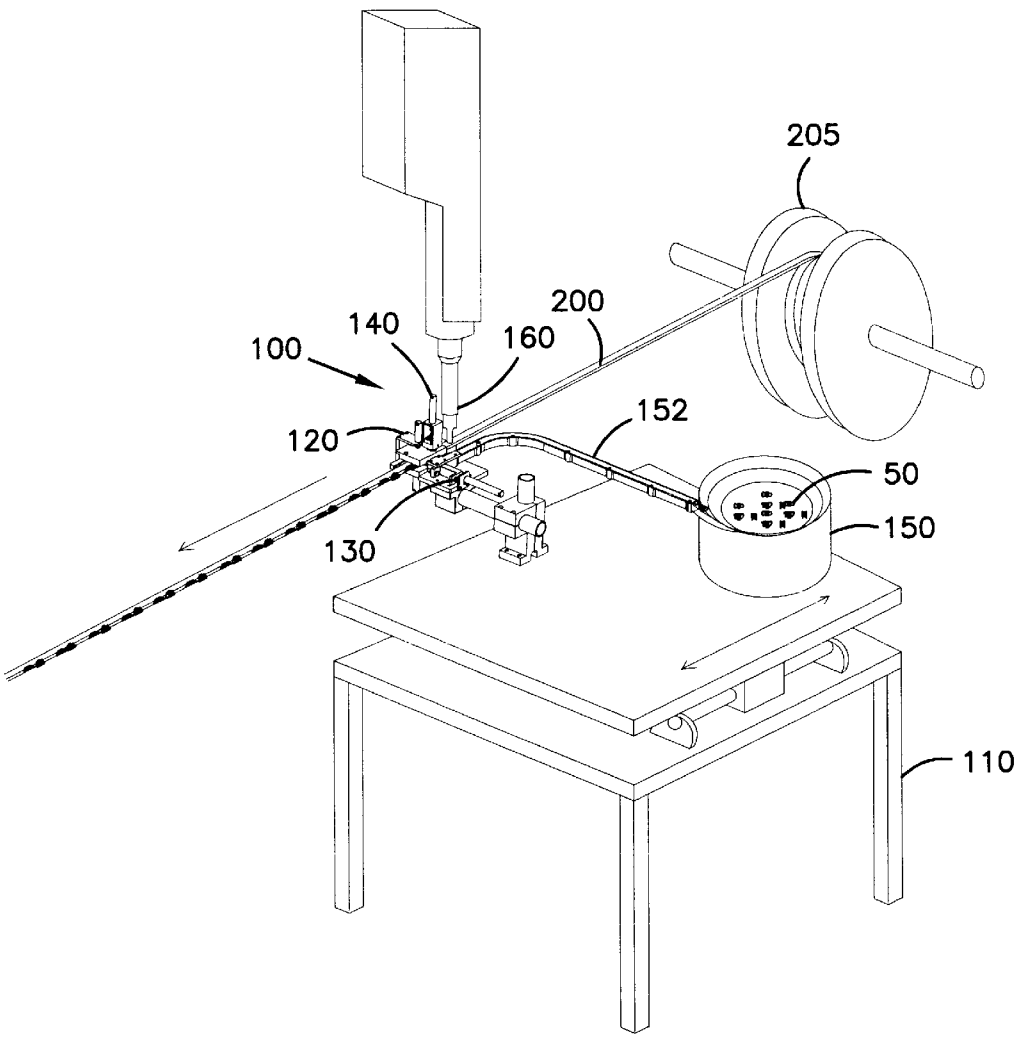
FIG. 7 is a schematic, perspective view of a process for mounting a slider device onto an extended length of zipper closure.

Slider device 50 is fed by a slider source such as bowl feeder 150, which properly orients slider device 50 for mounting onto distal ends 26, 28 of zipper closure 20. In FIG. 7, bowl feeder 150 is positioned on a table or other support 110. Slider devices 50 progress from bowl feeder 150 along feed track 152 to slider mounting system 100. Alternately, slider device 50 can be fed to slider mounting system 100 by multiple bowl feeders feeding a single track 152, a vibratory feeder, a spool of slider devices adhered to or carried on or by a carrier tape, a connected chain of slider devices, be manually fed, or by any other process that can provide a continuous supply of slider devices to slider mounting system 100. Gravity, an air stream, and other methods can be used to facilitate feeding of the slider devices. In one embodiment, a multi-channeled bowl feeder is used to orientate slider devices 50 to the proper position for application to zipper closure 20 by slider mounting system 100.

Slider mounting system 100, supported by table 110, has extended length of zipper closure 200 passing therethrough. Table 110 can include a registration system for providing fine tuning of spacing and positioning, as needed, of slider mounting system 100. Slider mounting system 100 can include a slider notch punch unit 140, a profile clamping unit 120, a slider installation mechanism 130, and a slider stop seal unit 160. The various features of slider mounting system 100 provide the following functions: profile clamp 120 securely holds zipper closure 20 during the various operations; slider installation mechanism 130 mounts slider device 50 onto zipper closure 20; punch unit 140 provides notch 25; and stop seal unit 160 forms slider stop regions 223, 225. Slider mounting system 100 is designed to have each of these various units (i.e., punch unit 140, profile clamp 120, slider installation mechanism 130, and slider stop seal unit 160) function together, in essence simultaneously, to provide an extended length of zipper closure 200 processed and ready to be incorporated into a package. Extended length of zipper closure 200 is incrementally indexed through slider mounting system 100, so that the processed zipper closure 20 has repeating features, that is, slider device 50, slider stop regions 223, 225, and notch 25.

Profile clamp 120 secures zipper closure 20 during the time the various procedures of slider mounting system 100 are performed on zipper closure 20. Profile clamp 120 can be any mechanism that can securely hold zipper closure 20; such mechanisms can include hinged clamps, arms, fingers, or any such items. Profile clamp 120 can hold each of first and second closure profiles 22, 24 individually, or can hold profiles 22, 24 with a single mechanism or surface. In some embodiments, it is preferred that profile clamp 120 has two opposed portions between which the zipper closure 20 is retained. Further, it is preferred that the surfaces of profile clamp 120 that contact zipper closure 20 are at least somewhat contoured to the profile zipper closure 20, so that the clamping pressure is fairly evenly distributed across first closure profile 22 and second closure profile 24.

Punch unit 140 provides notch 25 to zipper closure 20. Punch unit 140 may be a die, knife, stamp or other such process, and may be hydraulic or pneumatic. The small piece of polymeric material removed by punch unit 140 (herein referred to as a "slug") that defines notch 25 may be removed from the area of punch unit 140 by an air blast or by vacuum. In some embodiments, it may be desired to have a punch unit separate from slider mounting system 100; rather, a separate punch unit can be positioned upweb or downweb of slider mounting system 100.

Slider device 50 is applied to zipper closure 20 by slider installation mechanism 130, which can be any device or method for applying slider device 50 onto zipper closure 20. Generally, if closure profiles 22, 24 are mated, slider device 50 typically is applied at notch 25; if closure profiles 22, 24 are unmated, slider device 50 typically is applied at the opposite end of zipper closure 20, for example, close to slider stop region 225.

Slider stop seal unit 160 forms slider stop regions 223, 225. These regions 223, 225 are areas where closure profiles 22, 24 have been sealed together, typically by ultrasonic welding. In FIG. 8, slider stop regions 223, 225 are shown as a single region 224.

Additional details regarding slider mounting system 100 can be found in U.S. patent application Ser. No. 09/649,557, filed Aug. 28, 2000 and incorporated herein by reference.

Using zipper construction 201, resealable, reclosable packages according to the present disclosure can be manufactured by various methods, such as a horizontal form, fill and seal process. The package is manufactured, filled, and sealed by a single process that includes multiple sequential steps.

Figure 9:
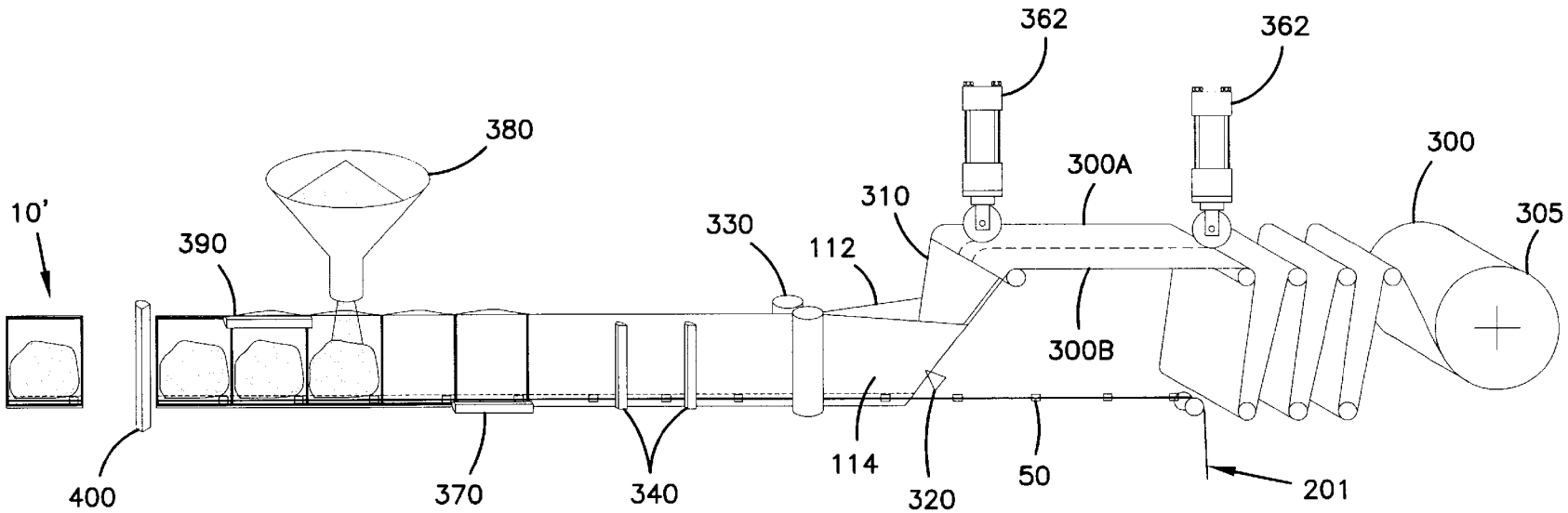
FIG. 9 is a schematic, perspective view of a horizontal form, fill, seal process for manufacturing and filling packages using an extended length of the zipper closure of FIG. 8.
Figure 10:
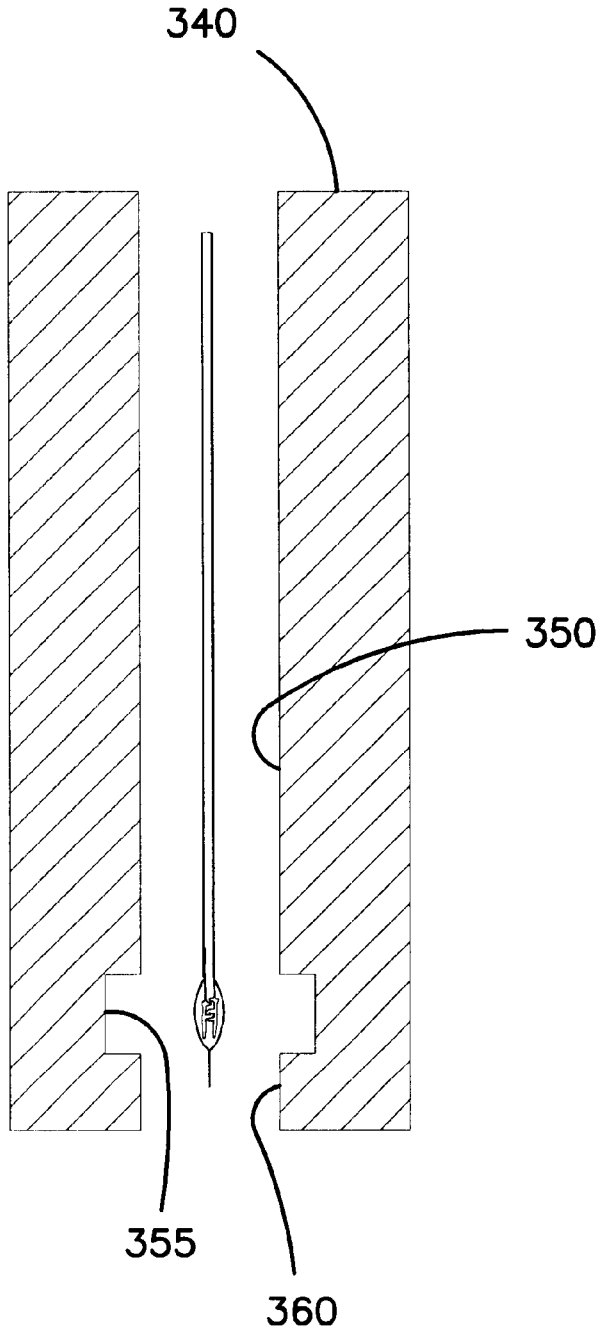
FIG. 10 is a schematic, side view of a vertical sealing bar of the process of FIG. 9.

Referring to FIG. 9, a horizontal form, fill and seal process is shown. As illustrated in FIG. 9, the process line progresses from right to left so that the final filled package is at the left side of the figure. Generally with a horizontal form, fill and seal process, the package can be manufactured upside-down so that the filling takes place through the bottom of the package, or, the package can be manufactured mouth-side up so that filling takes place through the top of the package. Throughout this disclosure, the edge of the package having the mouth 30 (FIG. 1) and the zipper closure 20 will be referred to as the "top" of the package. The edges of the package having bottom edge 17 is referred to as the "bottom" of the package. The process depicted in FIG. 10 shows the packages filled through the bottom of the package.

In FIG. 9, polymeric film 300, which will provide panels 12, 14 of surrounding wall 11 of the package, is provided on roll 305. In another embodiment, film 300 may be extruded, cast or otherwise formed immediately prior to this horizontal form, fill and seal process, thereby eliminating the step of winding the film after forming the film and then unwinding the film when the packages are made. The width of polymeric film 300, from first edge 300*a* to second edge 300*b*, is approximately twice the distance between bottom edge 17 (FIG. 1) and the top of tamper-evident structure 60 of the finished package. Various tensioners, idlers, rollers, positioners, and the like can be used to help control the position and tension of film 300.

Preferably prior to joining with zipper construction 201, film 300 is provided with weakness 62 (FIGS. 2 and 3). Equipment 362 is used to provide weakness 62; equipment 362 can be any equipment suited to provide weakness 62; examples of possible equipment includes a perforator, a laser, or other item that can provide the desired weakness.

Film 300 is folded to provide first and second film halves 112, 114 which will provide first and second side panels 12, 14 of the resulting package. This folding can be done by conventional methods, such as a V-board 310 or various rollers. In another embodiment, two separate pieces of film 300 can be used, one for each of side panels 12, 14; it is noted that if two separated pieces of film are used, then in order to form tamper-evident structure 60, the two pieces will be sealed together. The fold or seal between film halves 112, 114 forms tamper-evident structure 60.

A slitter knife 320 close to the base of the V-board 310 slits film 300, making an opening for passing zipper construction 201 therethrough. The extended length of zipper construction 201 is fed between the two film halves 112, 114 oriented so that distal ends 26, 28 are directed to the fold between film halves 112, 114. Guides, fingers, bars, rollers, or anything of the like may be used to manipulate either or both of film halves 112, 114 and extended length of zipper construction 201 to provide proper placement of zipper construction 201. Heated rollers 330 may be used to seal or pre-seal extended length of zipper closure 201 to film halves 112, 114.

Seal bars 340 provide vertical seals across the width of the folded film and zipper closure combination. These vertical seals will eventually result in side body seams 53, 55 and first tamper-evident structure seams 63, 65 of package 10, 10'. Between each side body seam formed by seal bars 340 is one slider device 50 and one notch 25; region 224 (FIG. 8) is split by seal bars 240 to form slider stop regions 223, 225. Seal bar 340 is shown enlarged in FIG. 10.

Seal bar 340 has a body sealing surface 350 and a first tamper-evident structure sealing surface 360, which are generally coplanar and both which can be heated to form seams. Body sealing surface 350 provides body seams 53, 55, and first tamper-evident structure sealing surface 360 provides first tamper-evident structure seams 63, 65. Seal bar 340 includes surface 355 that aligns with zipper closure 20 to form non-seam sections 230, 250, the areas void of side seams. Surface 355 is recessed in relation to surfaces 350, 360, so that surface 355 does not contact zipper construction 201 or film 300. However, if surface 355 were to contact zipper construction 201, zipper closure 20 has that portion that is constructed to not readily seal to panels 12, 14. Surface 355 is preferably not heated.

Typically, one seal bar 340 is positioned on each side of the film 300 and zipper closure 201. Heat can be provided from one or both sides of the film; additionally or alternatively, the temperature from one side to another can be the same or can be different. Multiple seal bars 340, such as shown in FIG. 9, can be heated to different temperatures. The process can be designed so that each seam area is contacted by multiple seal bars, or by only one bar.

If needed, seal bar 370 can be used to securely seal zipper construction 201 to film halves 112, 114.

The resulting package, semi-finished because bottom edge 17 has not yet been sealed, can be filled with items or material from hopper 380. In alternate embodiment s, the semi-finished package can be provided to a packaging facility, which will fill and complete the packages. Once filled, seal bar 390 forms bottom seam 57, and cutting bar 400 separates individual packages 10'.

Methods of Using Packages According to the Present Disclosure

To use the resulting package, such as package 10' (FIG. 2), tamper evident-structure 60, and, if present, tamper-evident structure 70 must be penetrated in order to access interior 21 of package 10'. First tamper evident-structure 60 is removed from over zipper closure 20 at weakness 62, which is positioned below zipper closure 20. The presence of non-seam sections 230, 250 facilitates removal of tamper-evident structure 60, because tamper-evident structure 60 is not adhered to zipper closure 20. Rather, the material forming tamper-evident structure 60 is generally only attached to panels 12, 14 at weakness 62, thus, breaking weakness 62 releases tamper-evident structure 60. Non-seam sections 230, 250 are generally removed from the package along with tamper-evident structure 60.

After first tamper evident-structure 60 is penetrated, first and second closure profiles 22, 24 of zipper closure 20 are unmated to open mouth 30; this action is facilitated by slider device 50, if present. If second tamper-evident structure 70 is present, in order to access interior 21, second tamper evident-structure 70 must be penetrated. Generally, second tamper evident-structure 70 is penetrated by breaking a weakness present therein. This weakness can be a perforation, zip-strip, a die line, laser score line or any mechanism or structure that allows for easy penetration. After second tamper evident-structure 70 has been penetrated, interior 21 is accessible.

The above specification is believed to provide a complete description of the manufacture and use of particular embodiments of the invention. Many embodiments of the invention can be made.

I claim:

1. A flexible, reclosable package comprising:

(a) a surrounding wall defining a package interior, the surrounding wall defined by a bottom edge and side edges, the side edges comprising:

(i) a body seam, (ii) a tamper-evident structure seam; and (iii) a non-seam section;

(b) a zipper closure comprising a first closure profile and a second closure profile, the first and second closure profiles being constructed and arranged to selectively interlock; the zipper closure having first and second stop regions proximate the non-seam section; the zipper closure providing access to the package interior; and (c) a first tamper evident-structure encasing the closure profiles.

2. The package according to claim 1 further comprising:

(a) a weakness within the first tamper-evident structure, the weakness positioned between the zipper closure and the bottom edge.

3. The package according to claim 1 wherein the stop regions are included within the non-seam sections.

4. The package according to claim 3 wherein a portion of the stop regions overlaps with the body seams.

5. The package according to claim 1 further comprising:

(a) a second tamper evident-structure between the zipper closure and the package interior.

6. The package according to claim 1 further comprising:

(a) a slider device operably mounted on the first and second closure profiles; the slider device constructed and arranged to interlock the first closure profile with the second closure profile when the slider device is moved in a first direction relative to the zipper closure, and to disengage the first closure profile from the second closure profile when the slider device is moved in a second opposite direction relative to the zipper closure.

7. A method of manufacturing a reclosable package comprising a zipper closure, the method comprising:

(a) providing an extended length of a zipper construction, the zipper construction comprising:

(i) a zipper closure comprising a first closure profile and a second closure profile, the first and second closure profiles being constructed and arranged to selectively interlock;

(ii) a stop region connecting the first closure profile to the second closure profile;

(b) sealing the extended length of the zipper construction to a surrounding wall;

(c) sealing the surrounding wall to partially define a package interior, the sealing providing:

(i) side body seams extending along a portion of the surrounding wall;

(ii) non-seam sections along the slider stop region; and (d) creating a bottom seam; the bottom seam and the side body seams defining the package interior.

8. The method according to claim 7, wherein the step of providing an extended length of a zipper construction comprises:

(a) providing a zipper closure comprising a seal resistant portion; the seal resistant portion resisting sealing to the surrounding wall.

9. The method according to claim 8, wherein the step of providing a zipper closure comprising a seal resistant portion comprises:

(a) co-extruding a first material and a second material for form the zipper closure.

10. The method according to claim 8, wherein the step of providing an extended length of a zipper construction comprises:

(a) ultrasonically welding the seal resistant portion to form the stop region to connect the first closure profile to the second closure profile.

11. The method according to claim 7, wherein the step of sealing the surrounding wall to partially define a package interior comprises:

(a) contacting the surrounding wall with a sealing bar having a first surface, a second surface, and a third surface:

(i) the first surface being in a first plane and forming the side body seams;

(ii) the second surface being in the first plane and contacting a portion of the surrounding wall to form a tamper-evident structure; and (iii) the third surface being recess from the first plane and lacking contact with the surrounding wall to form the non-seam sections.

12. The method according to claim 11, wherein the step of sealing the surrounding wall to partially define a package interior comprises:

(a) contacting the surrounding wall under heat and pressure.

13. The method according to claim 7, wherein the step of providing an extended length of a zipper construction comprises:

(a) providing an extended length of a zipper construction having:

(i) a slider device operably mounted on the zipper closure; the slider device constructed and arranged to interlock the first closure profile with the second closure profile when the slider device is moved in a first direction relative to the zipper closure, and to disengage the first closure profile from the second closure profile when the slider device is moved in a second opposite direction relative to the zipper closure; and (ii) a notch in the closure profiles.

14. The method according to claim 7, wherein the step of sealing the extended length of zipper construction to a surrounding wall comprises:

(a) sealing the extended length of zipper construction to a folded web of film material.

15. The method according to claim 14, wherein the step of sealing the extended length of zipper construction to a folded web of film material comprises:

(a) sealing the extended length of zipper construction to the folded web to form a first tamper-evident structure.

16. The method according to claim 7, wherein the step of providing an extended length of a zipper construction comprises:

(a) providing an extended length of a zipper construction having the sealing flanges of the closure profiles connected.

17. The method according to claim 7, wherein the steps of sealing the extended length of zipper construction to a surrounding wall, sealing the surrounding wall to partially define a package interior, and creating a bottom seam comprise:

(a) sealing the extended length of zipper construction to a surrounding wall, sealing the surrounding wall to partially define a package interior, and creating a bottom seam by a horizontal form, fill and seal process.

18. A method of using a package, the package comprising a surrounding wall having side edges each comprising a body seam and a non-seam section, the surrounding wall defining a package interior, a zipper closure comprising a first closure profile, a second closure profile, and stop areas in the non-seam section where the first closure profile is bonded to the second closure profile, and a first tamper evident-structure encasing the zipper closure, the first tamper-evident structure having a weakness positioned therein below the zipper closure; the method comprising:

(a) penetrating the first tamper-evident structure at the weakness;

(b) removing the first tamper evident-structure at the non-seam sections, while leaving the stop areas attached to the zipper closure;

(c) exposing the zipper closure; and (d) after exposing the zipper closure, unmating the first and second closure profiles.

19. The method according to claim 18, wherein the step of removing the first tamper evident-structure while leaving the stop areas attached to the zipper closure comprises:

(a) removing at least a portion of the non-seam section.

* * * * *